United States Patent [19]

Bird

[11] Patent Number: 4,530,303

[45] Date of Patent: Jul. 23, 1985

[54] APPARATUS FOR CONTROLLING HYDROPLANES OF MARINE VESSELS

[75] Inventor: Robert Bird, Loanhead, England

[73] Assignee: MacTaggert Scott (Holdings) Ltd., Loanhead, Great Britain

[21] Appl. No.: 522,007

[22] Filed: Aug. 11, 1983

[30] Foreign Application Priority Data

Aug. 12, 1982 [GB] United Kingdom ..... 8223264

[51] Int. Cl.[3] ..... B63G 8/18

[52] U.S. Cl. ..... 114/332; 114/126; 114/152

[58] Field of Search ..... 114/330–332, 114/126, 152, 275, 280, 163; 285/302

[56] References Cited

U.S. PATENT DOCUMENTS

| | | | |
|---|---|---|---|
| 2,979,010 | 4/1961 | Braddon et al. | 114/126 |
| 4,214,704 | 7/1980 | Nagai | 285/302 |

FOREIGN PATENT DOCUMENTS

| | | | |
|---|---|---|---|
| 752744 | 7/1956 | United Kingdom | 114/126 |
| 807411 | 1/1959 | United Kingdom | 114/126 |
| 832715 | 4/1960 | United Kingdom | 114/126 |

*Primary Examiner*—Sherman D. Basinger

*Attorney, Agent, or Firm*—Krass & Young

[57] ABSTRACT

According to the present invention there is provided apparatus for controlling the hydroplanes of a marine vessel comprising a pair of hydroplane-carrying crossheads mounted for movement towards and away from each other to effect retraction and extension of the hydroplanes into and out of the vessel, first hydraulic cylinders for effecting the retraction and extension movement of the crossheads, characterized in that there is provided second hydraulic cylinders independently and operatively associated with each of the crossheads for effecting tilting of each hydroplane about an axis thereof, and synchronizing gear associated with the second hydraulic cylinders for ensuring that tilting of each hydroplane is effected substantially in snychronism.

10 Claims, 5 Drawing Figures

APPARATUS FOR CONTROLLING HYDROPLANES OF MARINE VESSELS

BACKGROUND OF THE INVENTION

This invention relates to apparatus for controlling the hydroplanes of marine vessels and has particular, but not exclusive, application to hydroplanes for submarines.

Control apparatus for submarines has previously been proposed wherein port and starboard hydroplanes are each mounted on the outer end of a stock carrier on a crosshead. Each crosshead is slidably mounted on guide rails and the inner end of each stock is externally splined to co-operate with the internal splines of a common driving sleeve so that the stock can slide axially relative to its driving sleeve but cannot rotate relative thereto. Each driving sleeve is connected to a tilt lever mechanism through a torque tube for effecting angular movement of the sleeve about its axis in order to tilt the hydroplane mounted at the outer end of its associated stock. The tilt lever mechanism is actuated by an hydraulic piston and cylinder unit.

Extending between the port and starboard crossheads is a main hydraulic piston and cylinder which can be hydraulically actuated to enable the crossheads to be moved in and out of their guide rails thus effecting extension and retraction of the hydroplanes. During such extension or retraction, the external splines of the stocks slide relative to the associated internal splines of their respective sleeves. Tilting of each hydroplane is effected by actuating the tilting cylinder to operate the tilting lever assembly and cause the port and starboard torque tubes to be rotated. This causes rotation of the internally-splined sleeves and, due to the splines, rotation of the stocks and hydroplanes.

Hydraulic locking mechanisms are provided to enable the hydroplanes to be locked in predetermined positions of tilt (e.g. 16° and 0° respectively) as well as in extended or retracted positions.

The above-described apparatus has a disadvantage in that its components are required to be formed of a high tensile, non-ferrous material because they are located outside the pressure hull of the vessel and are continually immersed in sea water. A further disadvantage is that accurate athwartship alignment of the crossheads is required. For this reason, among others, the manufacturing costs are high.

SUMMARY OF THE INVENTION

An object of the present invention is to obviate or mitigate the aforesaid disadvantages.

According to the present invention there is provided apparatus for controlling the hydroplanes of a marine vessel comprising a pair of hydroplane-carrying crossheads mounted for movement towards and away from each other to effect retraction and extension of the hydroplanes into and out of the vessel, first hydraulic means for effecting said retraction and extension movement of the crossheads, characterised in that there is provided second hydraulic means independently and operatively associated with each of the crossheads for effecting tilting of each hydroplane about an axis thereof, and synchronising means associated with said second hydraulic means for ensuring that tilting of each of hydroplane is effected substantially in synchronism.

BRIEF DESCRIPTION OF THE DRAWINGS

An embodiment of the present invention will now be described with reference to the accompanying drawings in which.

DETAILED DESCRIPTION OF THE PREFERRED EMBODIMENT

Figure 1:
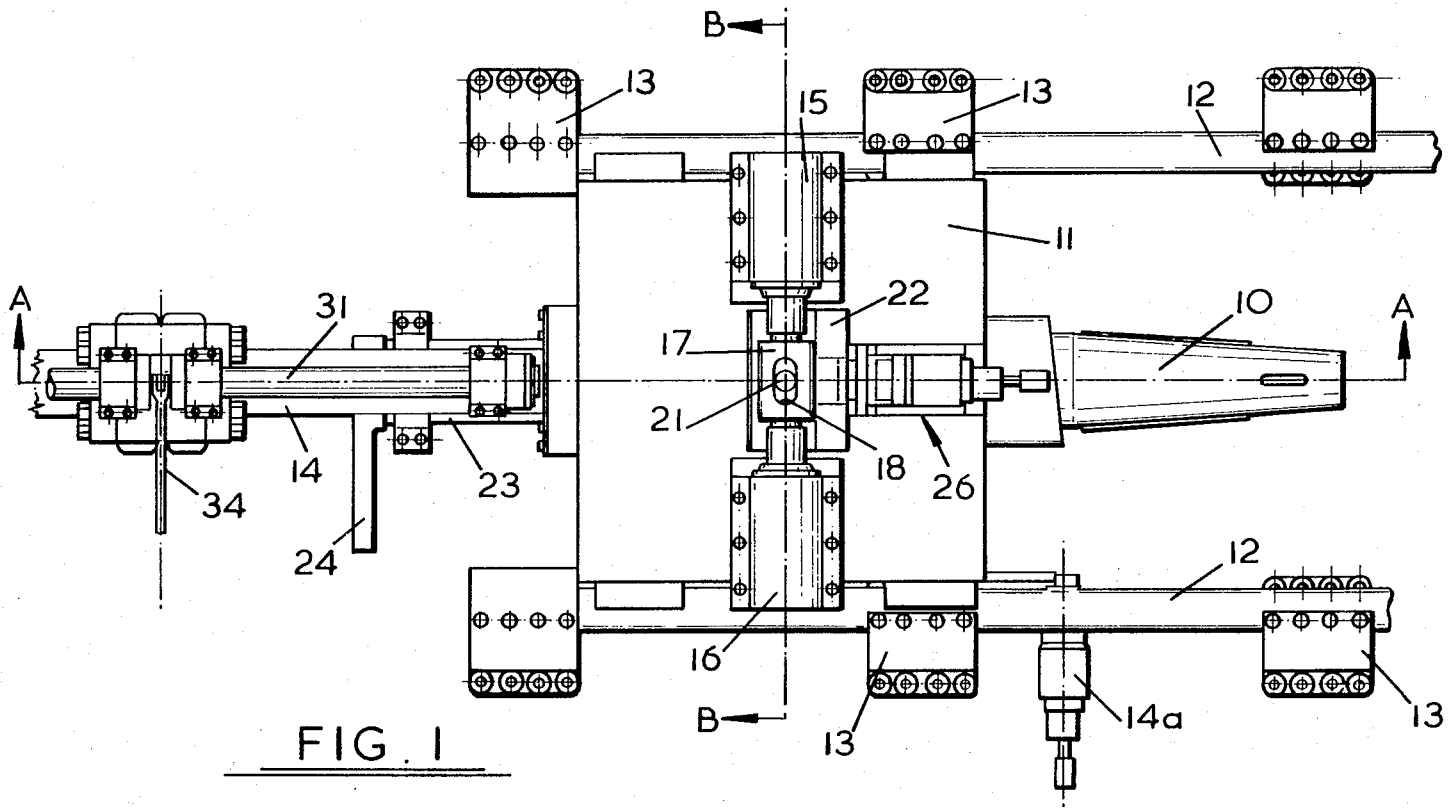
FIG. 1 is a plan view of the starboard half of hydroplane control apparatus for a submarine, the hydroplane being shown in retracted position.
Figure 2:
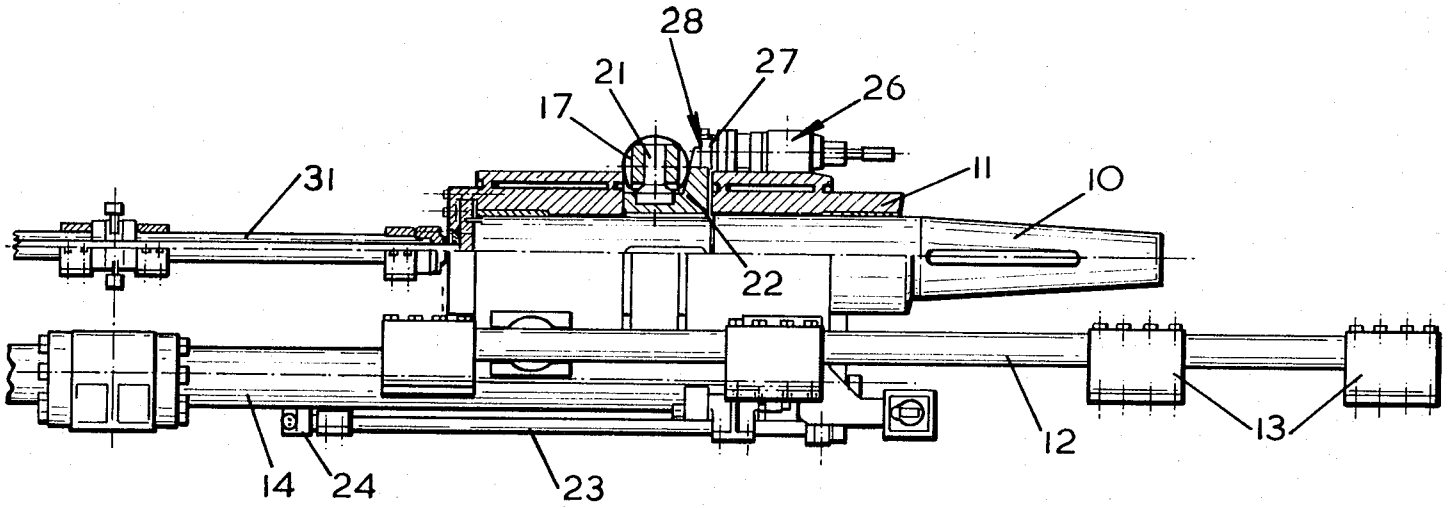
FIG. 2 is a part-sectional view on the line A—A of FIG. 1.
Figure 3:
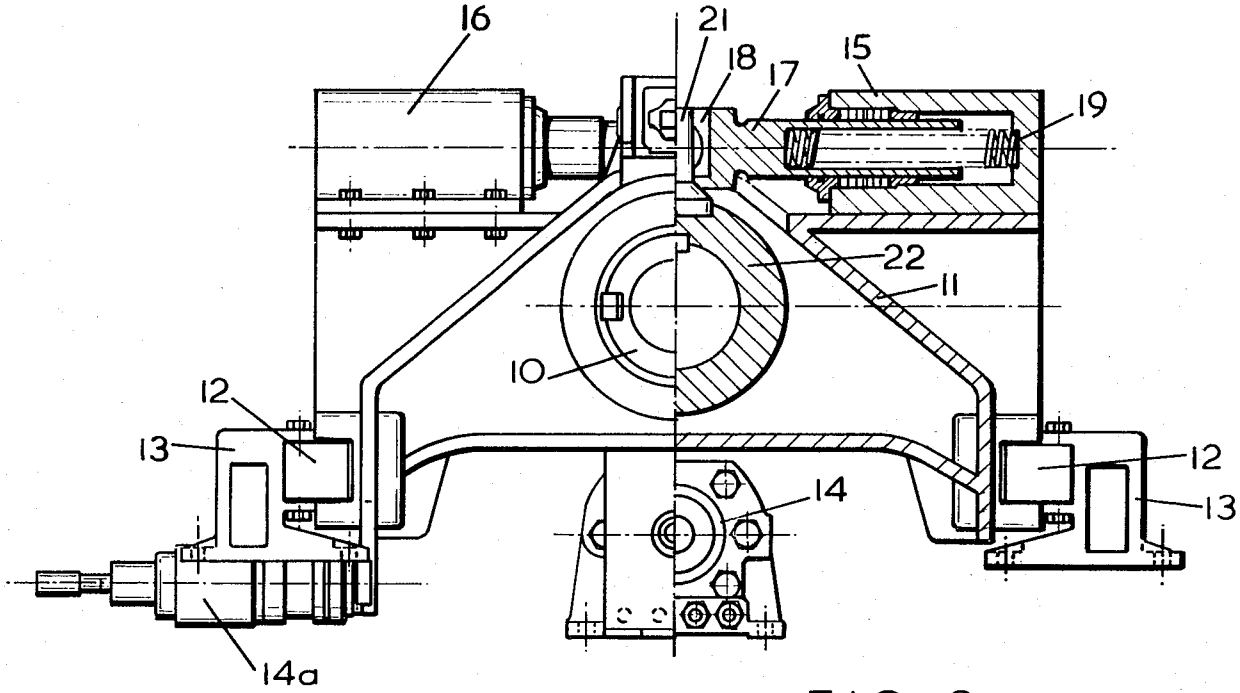
FIG. 3 is a part-sectional view to an enlarged scale on the line B—B of FIG. 1.

Referring to the drawings, FIGS. 1 to 4 illustrate apparatus for controlling the port and starboard hydroplanes of a vessel, particularly a submarine in order to control the pitch of said submarine about a transverse axis. In FIGS. 1 to 3, only the mounting and operation of the starboard hydroplane is described but it will be appreciated that the port hydroplane is analogous in its construction and operation.

Referring particularly to FIGS. 1 to 3, the hydroplane blade (not shown) is fitted to a shaft or stock 10. The stock 10 is carried by a crosshead 11 which can be extended outboard or retracted into the hull of the submarine. The crosshead 11 is mounted on guide rails 12 supported on blocks 13 and the crosshead 11 can be moved outwardly or inwardly along the rails 12 under the influence of a main hydraulic cylinder 14. The cylinder 14 is supplied with hydraulic oil from an external hydraulic main and an hydraulic locking device 14*a* is provided to enable the hydroplanes to be locked in an extended or retracted position.

The stock 10 is also rotatable about its own axis within limits in order to tilt the hydroplanes between, for example, 0° and 16°. Rotation of the stock 10 is effected by a pair of hydraulically operated tilt cylinders 15 and 16 between which extends a common piston 17 having an elongated slot 18 therein. Each end of the piston 17 is recessed to receive a spring 19 (FIG. 3) which tends to urge the piston out of its respective cylinder. A pin 21 projects into the elongated slot 18 in the piston 17 and the pin 21 is connected to the stock 10 through the intermediary of a sleeve 22 (FIG. 2). Actuation of the cylinder 15 or 16, both of which are double-sealed, causes the piston 17 to be extended to engage the pin 21 and move it angularly about the axis of the stock 10 in order to rotate the latter and consequently vary the angle of tilt of the hydroplane. Each tilt cylinder 15, 16 is supplied by reciprocating pump P with hydraulic pressure from the ring main system of the submarine by means of a telescopic hydraulic oil transfer tube 23. At its end remote from its associated tilt cylinder, the tube 23 is connected through a block 24 into the interior of pressure hull 25 (FIG. 5) of the submarine. Each telescopic tube 23 is of a sea water resistant copper/nickel alloy and the external portion of the tube is brazed to the pressure hull connection block 24 and the internal portion is brazed to the crosshead 11. Thus, no breakaway O-seal type pipe connections are used.

Figure 4:
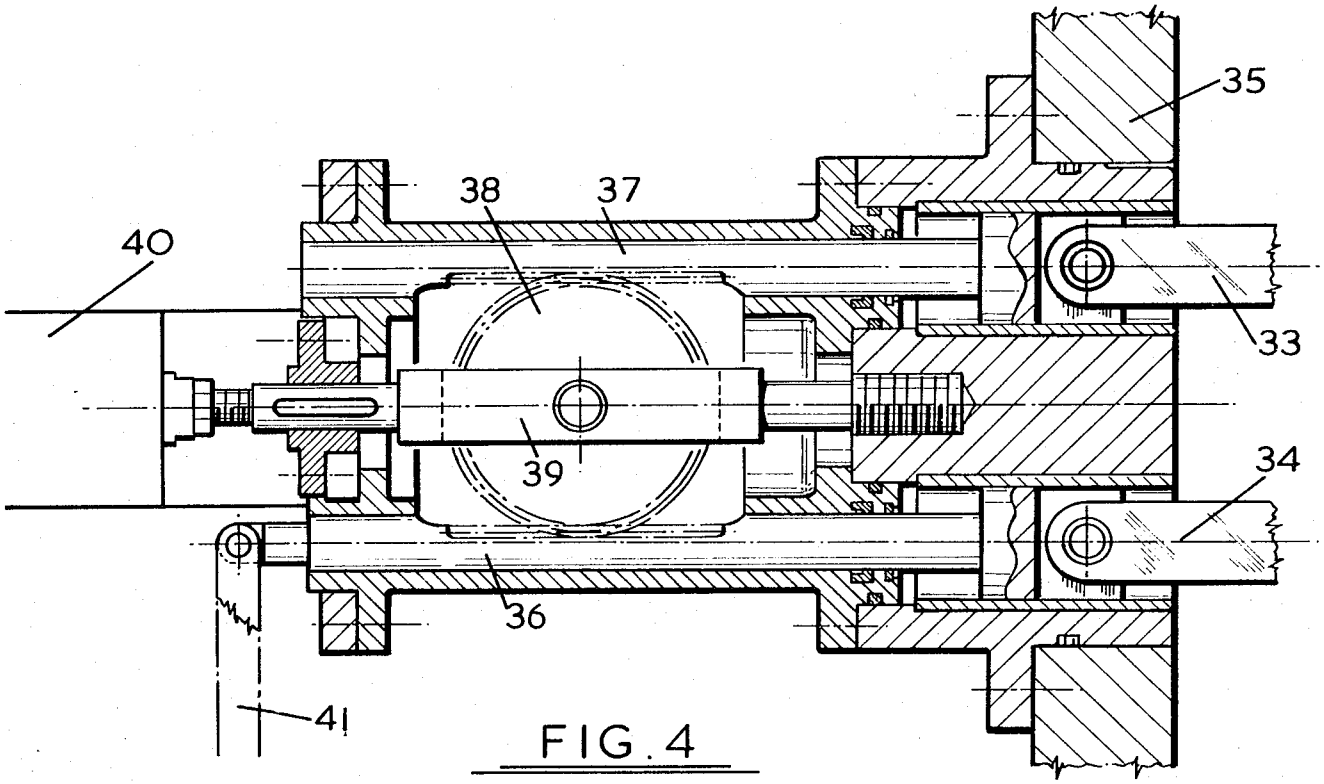
FIG. 4 is a sectional view of tilt synchronising gear for use with the apparatus for FIGS. 1 to 3.
Figure 5:
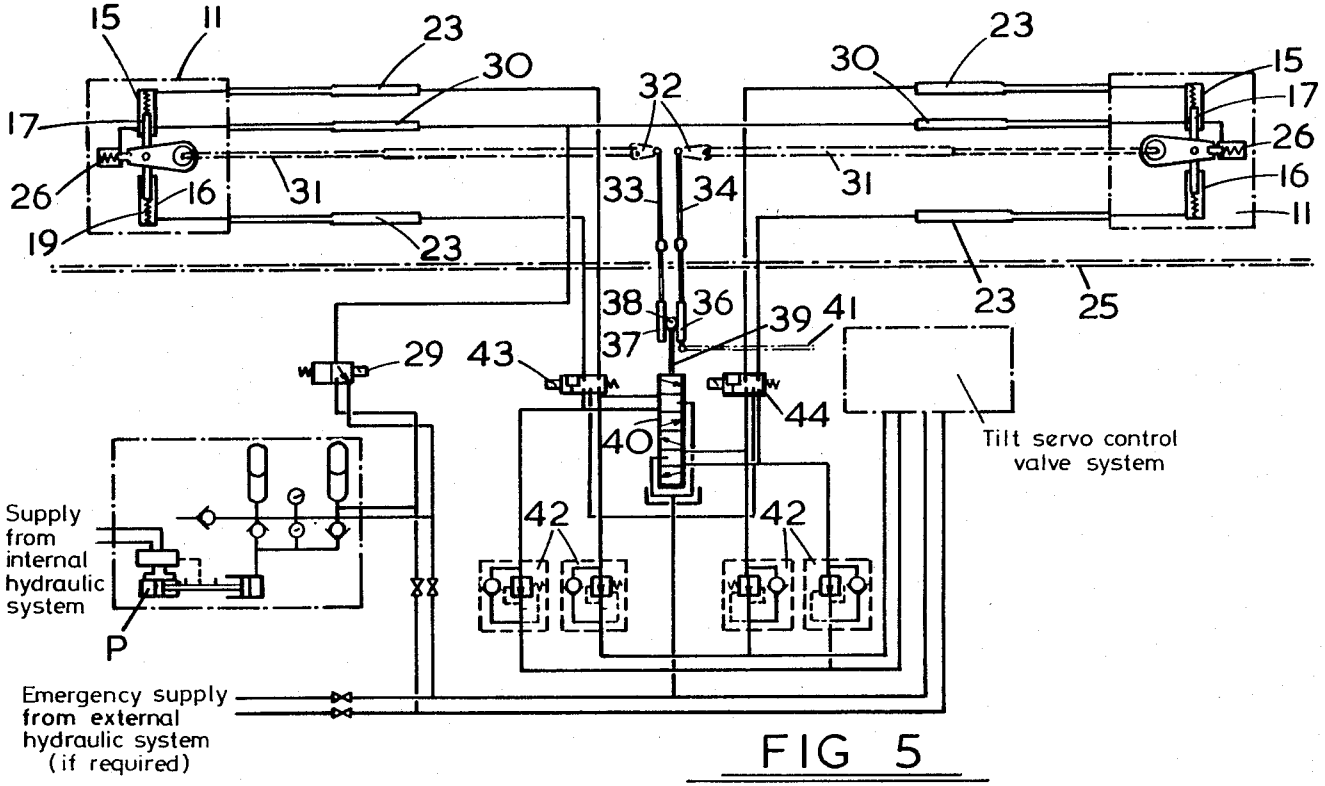
FIG. 5 is a diagrammatic illustration of one form of tilt cylinder operating circuit for effecting synchronism between tilt cylinders controlled port and starboard hydroplanes.

A tilt lock hydraulically-operated piston and cylinder unit 26 is mounted adjacent the tilt cylinders 15, 16. The spring-loaded piston of the unit 26 terminates in a projection 27 which is engageable in recesses 28 in an extension of sleeve 22 to enable the hydroplane to be locked in a predetermined angle of tilt e.g. 0° or 16°. Hydraulic oil supply to the tilt lock unit 26 is controlled through a solenoid valve 29 which allows oil to be supplied to the unit 26 through a telescopic tube 30. The stock 11 of the hydroplane is connected through suitable mechanical linkage to a telescopic tilt angle indicating tube 31. When the hydroplane is tilted on operation of one or other of the tilt cylinders 15, 16, such angular movement is transmitted to the tube 31 and thence as shown in FIGS. 4 and 5 through levers 32 to effect linear movement of rods 33, 34, the rod 33 being connected to the port hydroplane and the rod 34 to the starboard hydroplane. As shown in FIG. 4, the ends of the rods 33, 34 remote from their associated hydroplanes are connected through a gland 35 in the pressure hull 25 to a tilt synchronising gear located within the pressure hull 25. Each of the rods 34, 33 as shown in both FIGS. 4 and 5, is connected to a comparator comprising a toothed master and slave rack 36 and 37 respectively, the racks 36 and 37 being in mesh with a pinion 38 mounted on a rod 39 connected to a bleed off valve 40. The end of the master rack 36 remote from its rod 34 is connected through a servo control lever 41 to a customary servo control valve system. It will be appreciated that the starboard rod 34 and its associated master rack 36 move in the same direction as the starboard hydroplane blade tilt angle and provide mechanical feedback to the servo control gear. The rod 33 and its associated slave rack 37 move in the opposite direction to the master rack and the starboard hydroplane blade tilt angle. When the blade tilts, the pinion 38 rotates but there is no linear displacement of the pinion axis. If, however, there is a difference in angular movement between the port and starboard hydroplane blades, the pinion axis moves linearly to actuate the hydraulic bleed off valve 40 thereby continuously synchronising the angular movement of the port and starboard blades.

On sensing from the master rack 36, the tilt cylinders 15, 16 of the port and starboard hydroplanes are hydraulically operated through the servo control gear and pressure-compensated flow control valves 42 which are preset to give substantially identical tilt angle speeds to the port and starboard hydroplanes. Any angular misalignment of the blades during tilting is continuously compensated for by the synchronising mechanism as described above.

The tilting system described above contains components some of which are internal of the pressure hull 25 and some which are external thereof. The complete system is maintained supercharged at a pressure e.g. 30 Bar above maximum sea pressure in order to prevent any ingress of water into the system.

If desired, the tilt cylinders could be powered from an external hydraulic main in an emergency.

In operation of the hydroplane control apparatus of the invention, a pair of solenoid valves (not shown) are actuated in order to cause the main cylinder 14 for each of the port and starboard hydroplanes to extend the hydroplanes laterally out of the submarine.

When the hydroplanes are in the extended condition, the angle of tilt of each hydroplane is controlled by actuation of solenoid valves 43, 44 (FIG. 5) to cause hydraulic oil to flow from the internal hydraulic system into either the tilt cylinder 15 or 16 for each hydroplane in order to vary the angle of tilt to the desired extent. If it is desired to lock each hydroplane blade at a set inclination e.g. 0° or 16°, the tilt lock unit 26 is actuated.

During tilting movement of the hydroplane blades, the port and starboard blades are synchronised as regards angle of tilt by the synchronising gear in the manner previously described.

It will be appreciated that the oil transfer tubes 23 and 30 as well as the tilt angle indicating tubes 31 are telescopic in order to permit extension and retraction of the hydroplanes.

Although in the above-described embodiment, one particular means has been described for effecting synchronism in the speed of tilting of the hydroplane blades, it will be appreciated that other synchronising means can alternatively be employed. For example, the rack and pinion synchronising gear and reciprocating pump described above can be replaced by a direct oleo exchange system.

By virtue of the present invention, a control apparatus for the hydroplanes of a submarine can be achieved in which the weight is nearly halved as compared with previously proposed arrangements.

It will be further appreciated that the present invention provides an arrangement in which each crosshead houses its own dedicated tilt cylinder and lock which eliminates the need for splined torque tubes, associated bearings and ship support stools as in previously proposed arrangements, all of which were designed to transmit high sea slap loads and consequently were required to be manufactured from high-tensile non-corrosive materials which have to be surface coated for sliding during extension and retraction. By fitting tilt cylinders on the crossheads, the actuating loads are self-contained and thus the load on the ship's structure is reduced by transmitting only the externally applied operating loads.

As a result of the present invention, hydroplane blades of greater area can be employed because of the dedicated arrangement of hydroplane control units which remove the movement for intermediate torque tubes and associated control gear of previously proposed arrangements. Such torque tubes and control gear were normally located between port and starboard hydroplanes thus limiting the area of the hydroplane blades used.

I claim:

1. Apparatus for controlling the hydroplane of a marine vessel comprising a pair of hydroplane-carrying crossheads (11) mounted for movement towards and away from each other to effect retraction and extension of the hydroplanes into and out of the vessel, and first hydraulic means (14) for effecting said retraction and extension movement of the crossheads (11) characterized in that there is provided second hydraulic means (15,16,23) independently and operatively associated with each of the crossheads (11) for effecting tilting of each hydroplane about an axis thereof, a sensor (31,32,33,34) associated with each hydroplane for continuously detecting the angle of tilt of that hydroplane, a comparator (36,37,38) arranged to continuously receive and compare separate signals from each sensor indicative of the angular position of the respective hydroplane and operative in response to a sensed asychronous tilting of the hydroplane to generate an angular misalignment signal, and a servo mechanism (40,41,42)

receiving such misalignment signal and operative in response to such receipt to correct and sychronize the movement of the hydroplanes.

2. Apparatus as claimed in claim 1, in which said second hydraulic means comprises a piston and cylinder mechanism (15, 16) mounted on each crosshead (11), supply means for supplying hydraulic fluid to said second hydraulic means in order to effect actuation of the piston (17), and motion transmitting means (18, 21) for transmitting movement of the piston (17) into tilting movement of the hydroplane.

3. Apparatus as claimed in claim 2, in which the hydraulic fluid supply means comprises a telescopic conduit (23) which interconnects the second hydraulic means with the interior of a pressure hull (25) of the vessel.

4. Apparatus as claimed in claim 3, in which hydraulically-actuated locking means (26) is provided for locking each hydroplane in a predetermined angle of tilt.

5. Apparatus as claimed in claim 2, in which hydraulically-actuated locking means (26) is provided for locking each hydroplane in a predetermined angle of tilt.

6. Apparatus as claimed in claim 1, in which hydraulically-actuated locking means (26) is provided for locking each hydroplane in a predetermined angle of tilt.

7. Apparatus as claimed in claim 6, in which a telescopic conduit (30) is provided to supply hydraulic fluid to said locking means.

8. Apparatus as claimed in claim 1, in which the sensor comprises a mechanical linkage (31, 32, 33, 34) interconnecting each hydroplane and the comparator.

9. Apparatus for controlling the hydroplanes of a marine vessel comprising a pair of hydroplane-carrying crossheads (11) mounted for movement towards and away from each other to effect retraction and extension of the hydroplanes into and out of the vessel;

first hydraulic means (14) for effecting said retraction and extension movement of the crossheads (11);

second hydraulic means independently and operatively associated with each of the crossheads (11) for effecting tilting of each hydroplane about an axis thereof;

synchronizing means (31,32,33,34,36,37,38,40,41,42) associated with said second hydraulic means (15,16) for ensuring that tilting of each hydroplane is effected substantially in synchronism, said synchronizing means comprising a sensor (31,32,33,34) for detecting the angle of tilt of each hydroplane, a comparator (36,37,38) for receiving a signal from each hydroplane which indicates the angle of tilt thereof, and a servo mechanism (40,41,42) interconnecting the comparator and said second hydraulic means, said servo mechanism being operable on a difference in angular movement occurring between the hydroplanes in order to sychronize angular movement of the hydroplanes and characterized in that the comparator comprises a master and slave toothed rack mechanism (36,37) and a cooperating pinion (38), said pinion being rotatable about a fixed axis on synchronous tilting of the hydroplanes and said axis being linearly moveable on asynchronous tilting of the hydroplanes in order to effect actuation of the servo mechanism.

10. Apparatus as claimed in claim 9, in which said sensor comprises a mechanical linkage (31,32,33 or 34) interconnecting each hydroplane and the comparator.

* * * * *